US006701961B2

(12) United States Patent
Okuyama et al.

(10) Patent No.: US 6,701,961 B2
(45) Date of Patent: Mar. 9, 2004

(54) REED VALVE

(75) Inventors: Hiroshi Okuyama, Wako (JP); Hiroatsu Inui, Wako (JP); Kiyoshi Kidachi, Wako (JP); Toshinori Hanai, Wako (JP); Eizaburo Chiba, Katsushika-ku (JP); Mikio Satoh, Katsushika-ku (JP)

(73) Assignees: Honda Giken Kogyo Kabushiki Kaisha, Tokyo (JP); Arai Seisakusho Co., Ltd., Tokyo (JP)

( * ) Notice: Subject to any disclaimer, the term of this patent is extended or adjusted under 35 U.S.C. 154(b) by 61 days.

(21) Appl. No.: 10/081,336

(22) Filed: Feb. 22, 2002

(65) Prior Publication Data

US 2002/0112768 A1 Aug. 22, 2002

(30) Foreign Application Priority Data

Feb. 22, 2001 (JP) ..... 2001-047061

(51) Int. Cl.[7] ..... F16K 15/16
(52) U.S. Cl. ..... 137/856; 251/64
(58) Field of Search ..... 137/856, 855, 137/521, 857, 858; 251/64

(56) References Cited

U.S. PATENT DOCUMENTS 4,076,047 A * 2/1978 Akahori ..... 137/856
5,110,272 A * 5/1992 Peruzzi et al. ..... 137/856 X
5,178,183 A 1/1993 Kim
5,373,867 A 12/1994 Boyesen et al.

* cited by examiner

*Primary Examiner*—Kevin Lee
(74) *Attorney, Agent, or Firm*—Merchant & Gould, P.C.

(57) ABSTRACT

A reed valve includes a vibration suppressing member for suppressing transmission of vibration, caused due to opening and closing operations of a reed piece, to a fixed mounting portion of an engine part to which the reed valve is mounted. The vibration suppressing member includes an elastic annular projection formed on at least one of an outer peripheral surface of a gasket fitted around an outer peripheral edge of a valve plate and a pair of upper and lower surfaces of the gasket. The elastic annular projection is elastically engaged with the fixed mounting portion when the mount portion of the valve plate is mounted to the fixed mounting portion.

10 Claims, 4 Drawing Sheets

REED VALVE

FIELD OF THE INVENTION

The present invention relates generally to a reed valve and, more particularly, to a reed valve suitable for supplying air to an intake system or an exhaust system of an engine.

BACKGROUND OF THE INVENTION

Generally, reed valves are used for supplying air to an intake system or an exhaust system of an engine. In an intake system of a two-cycle engine, for example, a reed valve is disposed in an intake pipe connected between a carburetor and a crankcase so that a negative pressure produced by vertical movements of a piston is utilized to cause air/fuel mixture to be drawn via the reed valve into the crankcase for eventual combustion within a combustion chamber of the engine. The reed valve also shuts off the flow of the mixture into the crankcase when the crankcase has a high internal pressure.

In a secondary air supply apparatus of an engine often used to meet the requirements under the exhaust emission control regulations, a reed valve is disposed in a connector tube connecting an air cleaner and a pipe of an exhaust system. A pressure difference between an upstream side and a downstream side of the reed valve, which is created in the exhaust system due to pulsation of exhaust gases, is utilized to cause air to be drawn from the air cleaner via the reed valve into the exhaust gases in the exhaust system for re-combustion of exhaust gases so that unburnt components in the exhaust gases are caused to burn. The reed valve also prevents a back-flow of exhaust gases to the air cleaner when the pressure of the exhaust system is high.

FIGS. 5 through 8 show a conventional reed valve used in a secondary air supply system of an engine. The conventional reed valve 1 includes a plate-like support base 2 made of metal such as aluminum and having a generally rectangular shape when viewed in plan. The support base 2 has a valve port 3 formed at a substantially central portion across the thickness thereof for the passage therethrough of a fluid. The valve port 2 also has a generally rectangular shape when viewed in plan. An outer peripheral portion of the support base 2 forms a mount portion 2*a* adapted to be mounted, in an embraced manner, in an attachment groove 4 (FIG. 8) formed in an object, such as a mounting portion of a connector pipe of the engine or a case mounted on the mounting portion of the connector pipe. On a surface of the mount portion 2*a,* particularly both an upper surface and a lower surface of the outer peripheral portion of the support base 2, a first gasket portion 5 formed by a thin film of elastic material such as rubber is provided. The first gasket portion 5 has on its upper and lower surfaces a pair of annular projections 5*a,* 5*a,* respectively, so as to prevent the fluid from leaking outside the device when the fluid passes through the valve port 3. A second gasket portion 6 formed by an elastic material such as rubber is provided on an inner peripheral surface of the valve port 3 and both on upper and lower surfaces of a central portion of the support base 2 contiguous to the valve port 3. On an upper side of the second gasket portion 6, a generally hollow rectangular frame-like valve seat 6*a* extending around the valve port 3 is formed.

A substantially rectangular reed piece 7 is disposed on an upper surface of the support base 2 and normally closes the valve port 3. The reed piece 7 is adapted to open and close in response to the pressure of the fluid passing through the valve port 3. A reed stop 8 is disposed on an upper side of the reed piece 7 so as to limit or define an open position of the reed piece 7. The reed piece 7 and reed stop 8 are clamped at one end (left end in FIG. 5) to the upper surface of the support base 2 in a cantilevered fashion by a suitable clamp means such as an attaching screw 9 threaded into the support base 2 from the lower surface thereof.

The reed piece 7 operates to allow the fluid to pass through the valve port 3 in one direction from below to above and to block the flow of the fluid in the opposite direction. The reed piece 7 is formed from a resilient sheet of metal or plastic.

The reed stop 8 is formed from a rigid metal and bent at an angle such that the distance from the upper surface of the support base 2 has a maximum value at a free end (right end in FIG. 5) of the reed stop 8.

In the reed valve 1 of the foregoing construction, as shown in FIG. 8, the upper and lower annular projections 5*a* of the first gasket portion 5 formed on the mounting portion 2*a* of the support base 2 are fully squeezed out of shape by being compressed between two opposed rigid surfaces of the attachment groove 4, so as to form a seal surface extending around the mount portion 2*a*. By the seal surface, it is possible to prevent leakage of the fluid which may otherwise occur when the fluid is passing through the valve port 3. As shown in FIG. 5, the reed stop 8 secures a static flow rate by increasing the amount of lift (i.e., the distance from the valve seat 6*a*) of the reed piece 7 when the reed piece 7 is in the open state.

As indicated by solid line shown in FIG. 5, the reed piece 7 is normally in contact with the valve seat 6*a* and thus closes the valve port 3 of the support base 2 from the upper side thereof. Furthermore, by a pressure difference created between an upper side and a lower side of the reed valve 1 due to pulsation of exhaust gases, the reed piece 7 is caused to oscillate between the solid-lined closing position in which the reed piece 7 is in contact with the valve seat 6*a* at a lower surface thereof to thereby close the valve port 3, and the phantom-lined open position in which the reed piece 7 is in contact with the reed stop 8 at an upper surface thereof to thereby open the valve port 3. Thus, the reed valve 1 is constructed to allow the flow of the fluid in only one direction from below to above of the valve port 3 and to block the flow in the opposite direction.

The conventional reed valve 1 has a problem, however, that vibrations generated during opening and closing operations of the reed piece 7 are transmitted to the attachment groove 4, thereby causing the engine to produce a high level abnormal sound or noise. This problem becomes significant when the engine is operating at relative low speeds where the high level noise is offensive to the ear.

SUMMARY OF THE INVENTION

With the foregoing problem in view, it is an object of the present invention to provide a reed valve that is capable of suppressing transmission of vibrations produced by repetitive opening and closing operations of a reed piece thereby to surely prevent generation of an abnormal sound or noise.

To achieve the foregoing object, according to the present invention, there is provided a reed valve which is equipped with a vibration suppressing means for suppressing transmission of vibrations, produced by repetitive opening and closing operations of a reed piece, to a fixed mounting portion of, for example, an engine part.

The vibration suppressing means may comprise an elastic annular projection formed on an outer peripheral surface of a gasket fitted around an outer peripheral surface of a valve plate and a pair of upper and lower surfaces of the gasket, or only on the outer peripheral surface of the gasket, the elastic annular projection being elastically engaged with the fixed mounting portion when the outer peripheral portion of the valve plate is mounted to the fixed mounting portion. The annular projection elastically engaged with the fixed mounting portion is able to reduce a contact area between the outer peripheral portion of the valve plate and the fixed mounting portion. Further, when subjected to vibration from the reed piece, the annular projection elastically deforms to thereby absorb the vibration before the vibration is transmitted to the fixed mounting portion.

A cantilevered reed stop clamed to the valve plate together with the reed piece for defining an open position of reed stop may have an arch-shaped portion projecting outward away from the valve plate and extending diametrically across over the valve port. The arch-shaped portion of the reed stop preferably has an apex corresponding in position to a central portion of a valve port formed in the valve plate. By virtue of the arch-shaped portion, a maximum amplitude of oscillation of the reed piece during opening and closing operations occurs at a position corresponding to the central portion of the valve port. This means that the distance from a source of maximum vibration to the fixed mounting portion is made longer than that of the conventional reed valve wherein a reed stop is bent at an angle to the valve plate so that the maximum amplitude of oscillation of the reed piece occurs at a free end thereof. By using the arched reed stop, the amount of lift of the reed piece at the free end thereof can be reduced with the result that a shock or impact produced when the reed piece free end impinges on a surface of the valve plate is reduced.

BRIEF DESCRIPTION OF THE DRAWINGS

A preferred embodiment of the present invention will hereinafter be described in detail, by way of example only, with reference to the accompanying drawings, in which.

DETAILED DESCRIPTION OF THE PREFERRED EMBODIMENT

FIGS. 1 through 4 show a reed valve according to an embodiment of the present invention. In the illustrated embodiment, the reed valve 11 is used in a secondary air supply device 10 (FIG. 4) of an engine.

Figure 1:
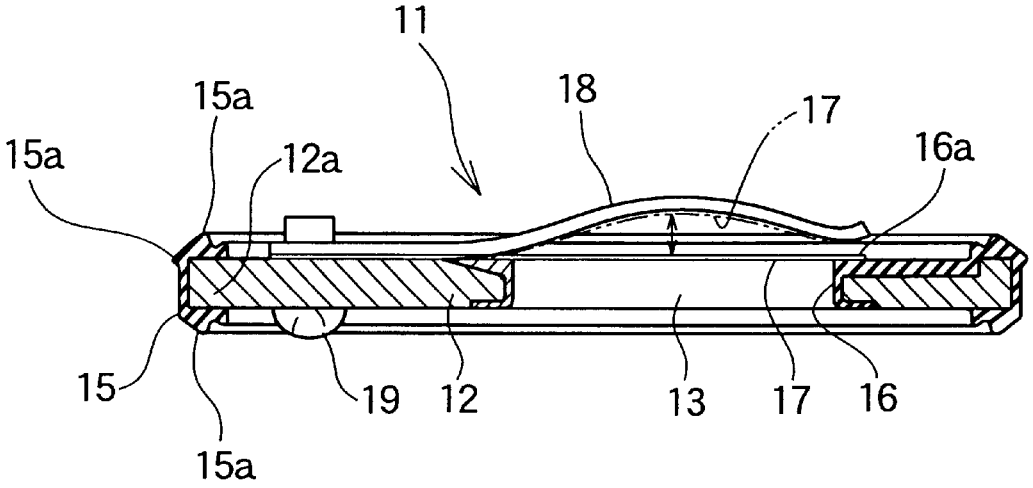
FIG. 1 is a longitudinal cross-sectional view of a reed valve according to an embodiment of the present invention.
Figure 2:
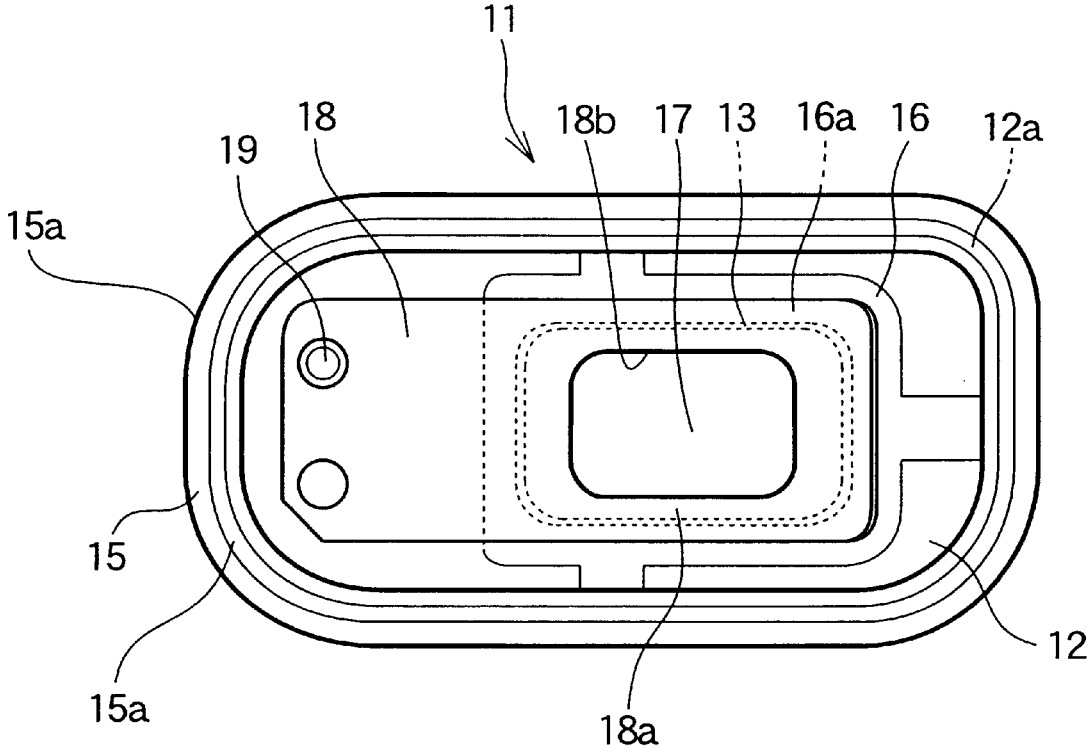
FIG. 2 is a plan view of FIG. 1.
Figure 3:
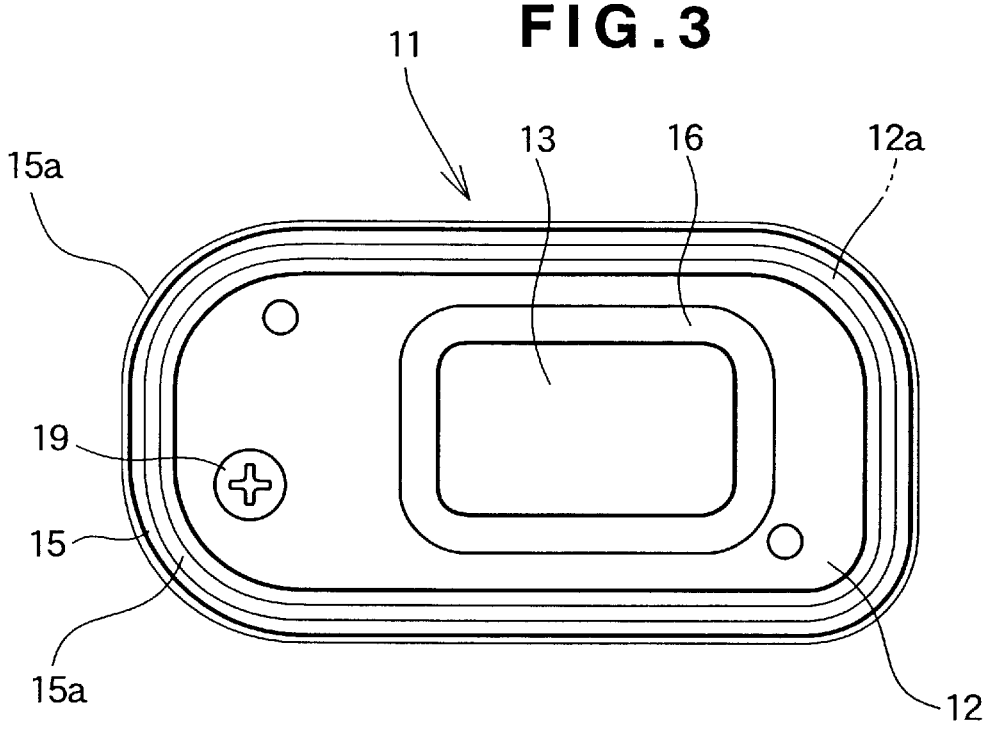
FIG. 3 is a bottom view of FIG. 1.

As shown in FIGS. 1 to 3, the reed valve 11 includes a generally rectangular valve plate 12 made of metal such as aluminum. The valve plate 12 has a generally rectangular valve port 13 formed at a substantially central portion across the thickness thereof for the passage therethrough of a fluid. An outer peripheral portion of the valve plate 12 forms a mount portion 12*a* adapted to be mounted, in an embraced manner, in an attachment groove 14 (FIG. 4) formed in an engine part 10, such as a fixed mounting portion of a connector pipe of the engine or a case mounted on the mounting portion of the connector pipe. On a surface of the mount portion 12*a,* especially upper and lower surfaces of the outer peripheral portion of the valve plate 12 and an outer peripheral surface of the valve plate 12, a first gasket portion 15 is provided so as to embrace these surface portions. The first gasket portion 15 is formed by a thin layer of elastic material such as rubber. An upper surface, a lower surface and an outer peripheral surface of the first gasket portion 15 each have an elastic annular projection 15*a.*

Figure 4:
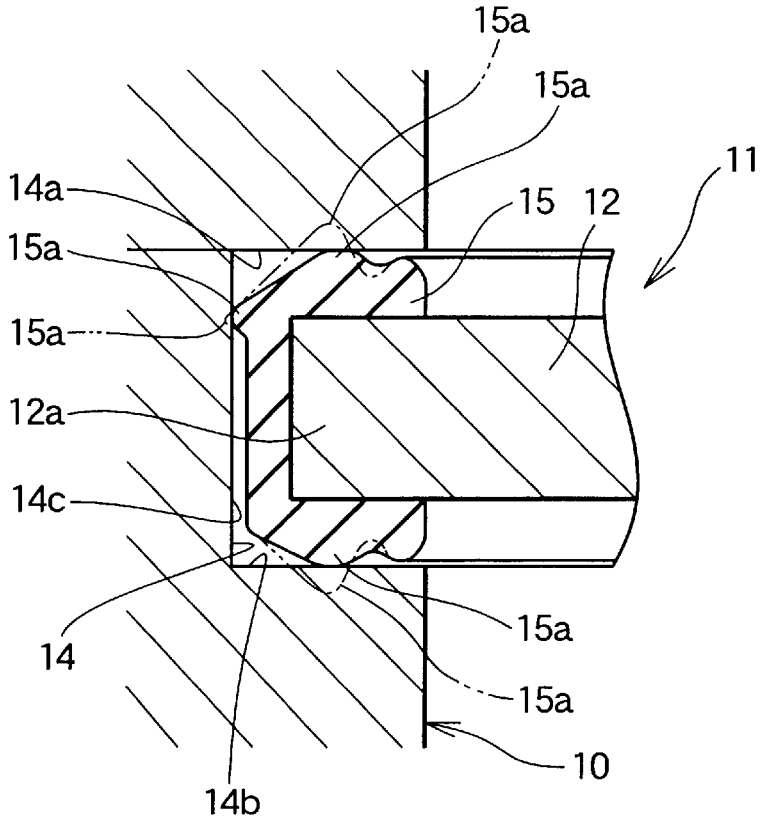
FIG. 4 is an enlarged cross-sectional view illustrative of the manner in which the reed valve shown in FIG. 1 is mounted in an attachment groove of the secondary air supply device of an engine.
Figure 5:
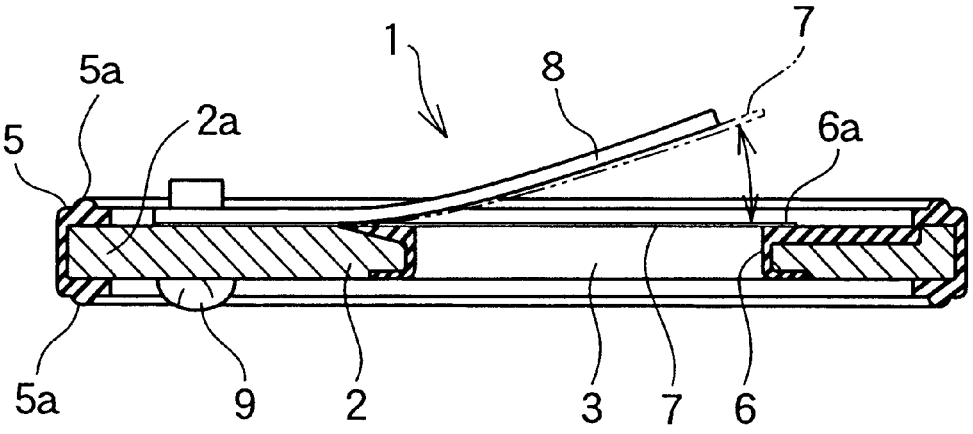
FIG. 5 (PRIOR ART)
FIG. 5 is a longitudinal cross-sectional view of a conventional reed valve.
Figure 6:
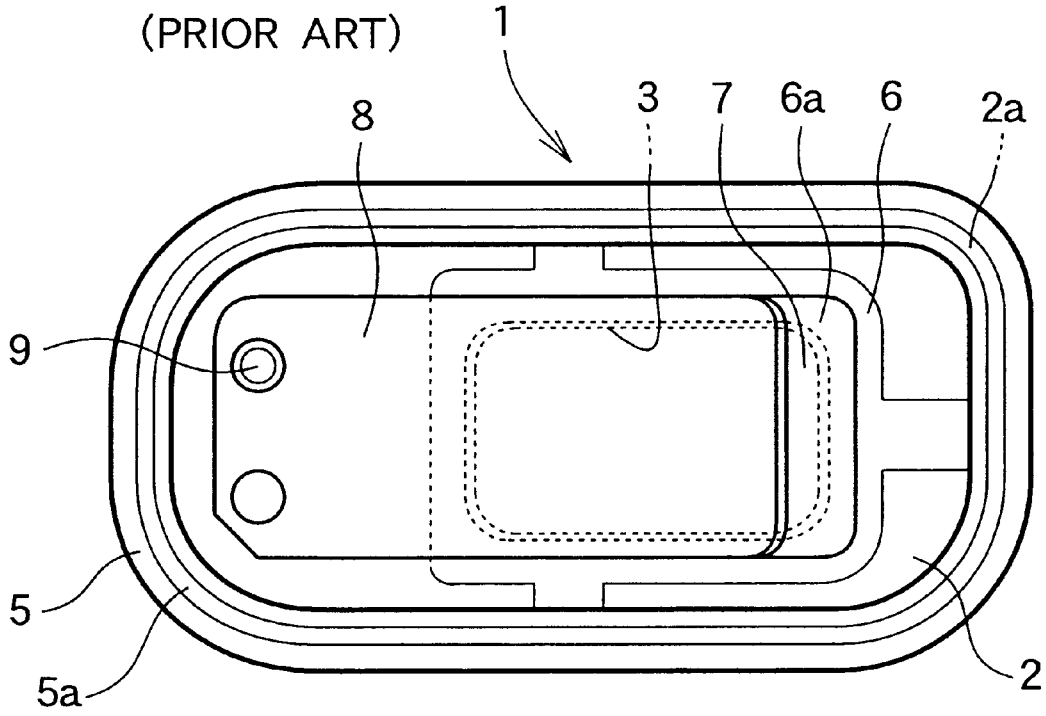
FIG. 6 (PRIOR ART)
FIG. 6 is a plan view of FIG. 5.
Figure 7:
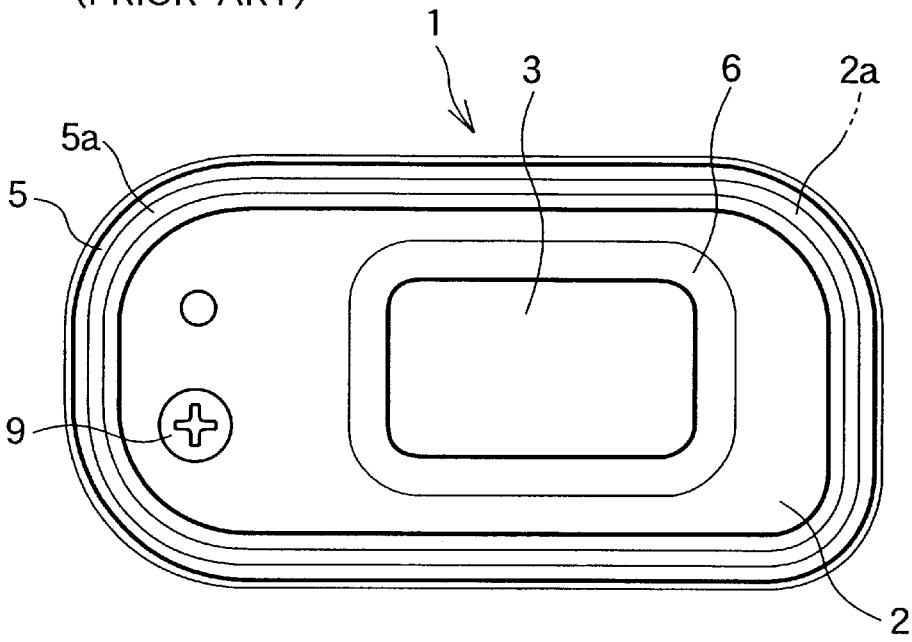
FIG. 7 (PRIOR ART)
FIG. 7 is a bottom view of FIG. 5.
Figure 8:
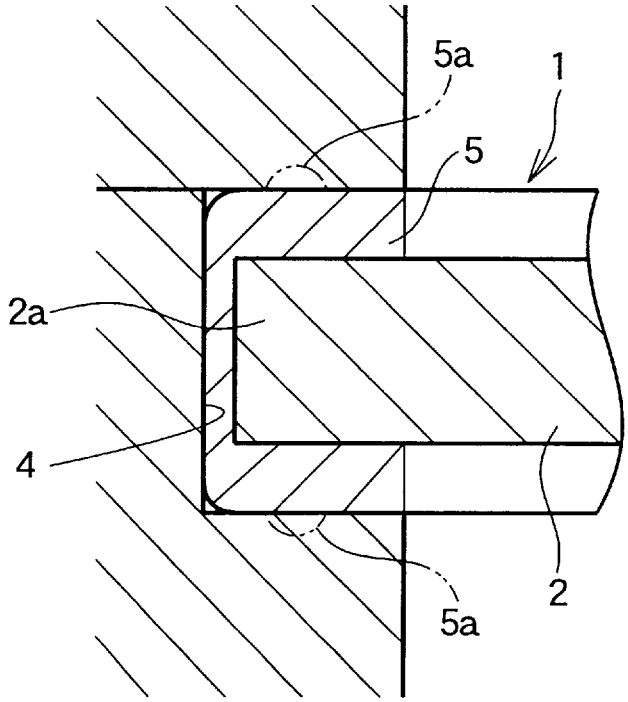
FIG. 8 (PRIOR ART)
FIG. 8 is an enlarged cross-sectional view illustrative of the manner in which the reed valve shown in FIG. 5 is mounted in an attachment groove of the secondary air supply device of an engine.

As shown in FIG. 4, when the mount portion 12*a* of the valve plate 12 is fitted in the attachment groove 14, the annular projections 15*a* are elastically engaged with upper and lower surfaces 14*a,* 14*b* and an inner peripheral surface 14*c* of the attachment groove 14 so that the valve plate 12 (i.e., the reed valve 1 as a whole) is elastically supported within the attachment groove 14.

Referring back to FIGS. 1–3, a second gasket portion 16 formed by a thin film of elastic material such as rubber is provided on an inner peripheral surface of the valve port 13 and both an upper and lower surfaces of a central portion of the valve plate 12 contiguous to the valve port 13. An upper side of the second gasket portion 16 forms a generally hollow rectangular frame-like valve seat 16*a* extending around the valve port 13.

A substantially rectangular reed piece 17 is disposed on an upper surface of the valve plate 12 so as to close the valve port 13. The reed piece 17 is adapted to open and close in response to the pressure of the fluid passing through the valve port 13. A reed stop 18 is disposed on an upper side of the reed piece 17 so as to limit or define an open position of the reed piece 17. The reed piece 17 and reed stop 18 are clamped at one end (left end in FIG. 1) to the upper surface of the valve plate 12 in a cantilevered fashion by a suitable clamp means such as an attaching screw 19 threaded into the valve plate 2 from the lower surface thereof. The attaching screw 19 may be replaced by a rivet known per se.

The reed piece 17 operates to allow the fluid to pass through the valve port 13 in one direction from below to above and to block the flow of the fluid in the opposite direction. The reed piece 17 is formed from a resilient sheet of metal or plastic.

The reed stop 18 is formed from a rigid metal and has an arch-shaped intermediate portion 18*a* projecting outward away from the upper surface of the valve plate 12 and extending between a left edge of the valve port 13 located adjacent to the fixed end of the reed stop 18 and a right edge of the valve port 13 located adjacent to a free end of the reed stop 18. The arch-shaped intermediate portion 18*a* of the reed stop 18 has an apex at a central portion thereof, which is corresponding in position to a longitudinal central portion of the valve port 18. The amount of lift (i.e., the distance from the valve seat 16*a*) of the reed piece 17 is thus determined by the arch-shaped intermediate portion 18*a* of the reed stop 18 such that the maximum amplitude of oscillation of the reed piece 17 during opening and closing operations occurs at the longitudinal central portion of the rectangular valve port 13. By the arch-shaped intermediate portion 18*a* of the reed stop 18, the amount of lift of the reed piece 17 is made small at the free end portion thereof. The reed stop 18 has a rectangular vent hole 18*b* (FIG. 2) formed in the arch-shaped intermediate portion 18*a* in concentric relation to the rectangular valve port 13 for allowing smooth passage of the fluid. The vent hole 18*b* is smaller in size (or area) than the valve port 13.

The annular projections 15*a* formed on the upper surface, lower surface and outer peripheral surface of the first gasket portion 15 form a first vibration suppressing means. The first vibration suppressing means 15*a* is elastically engaged with surfaces of the attachment groove 14 when the mount portion 12*a* is fitted in the attachment groove 14 to mount the reed valve 11 to the engine part.

The arch-shaped intermediate portion 18*a* of the reed stop 18, which projects outward away from the valve plate 12 so as to form an apex vertically aligned with a longitudinal central portion of the valve port 13, forms a second vibration suppressing means.

By thus providing the first and second vibration suppressing means 15*a*, 18*a*, it is possible to suppress transmission of vibrations, caused due to repetitive opening and closing operations of the reed piece 17, to the attachment groove 14 of the fixed engine part 10.

The reed valve 11 may be attached either directly to the engine or indirectly via a case (not shown) to the engine.

The reed valve 11 of the foregoing construction operates as follows. Opening and closing operations of the reed valve 11 are substantially the same as that of the conventional reed valve 1 discussed previously with reference to FIGS. 5–8, and description given below will be limited to significant differences from the conventional reed valve 1 only in conjunction with the vibration suppressing effect.

When the reed valve 11 is mounted in the attachment groove 14, as shown in FIG. 4, the annular projections 15*a* (forming the first vibration suppression means) are elastically engaged with the surfaces 11*a*–14*c* of the attachment groove 14 with a relatively small contact area formed between each projection 15*a* and the corresponding groove surface 14*a*–14*c*. Thus, by the elasticity of the annular projections 12*a* being partly deformed elastically, the valve plate 12 and thus the reed valve 11 as a whole is elastically supported within the attachment groove 14. The reed valve 11 is thus arranged in a floating condition. Under such condition, by a pressure difference created between an upper side and a lower side of the reed valve 11 due to pulsation of exhaust gases, the reed piece 17 is caused to oscillate in the directions indicated by the arrowhead shown in FIG. 1 between a solid-lined closing position in which the reed piece 17 is in contact with the valve seat 16*a* at a lower surface thereof to thereby close the valve port 13, and a phantom-lined open position in which the reed piece 17 is in contact with the reed stop 18 at an upper surface thereof to thereby release itself from the valve seat 16*a* and thus opening the valve port 13. During that time, the annular projections (first vibration suppressing means) 15*a* elastically supporting the valve plate 12 relative to the attachment groove 14 elastically deform to thereby absorb vibration transmitted from the reed piece 17 being oscillated. By thus absorbing the vibration, the guide groove 14 of the engine part 10 is kept substantially free from the effect of vibration of the reed piece 17. This ensures that the engine does not produce an abnormal sound or noise resulting from operation of the reed valve 11.

The same vibration suppressing effect and the resulting noise prevention effect can be also achieved when the first vibration suppressing means is formed by either the annular projection 15*a* on the outer peripheral surface of the first gasket portion 15, or the annular projections 15*a*, 15*a* on the upper and lower surfaces of the first gasket portion 15.

When the annular projections 15*a* are in a free state, they are disposed in an initial position indicated by the phantom lines shown in FIG. 4. When the reed valve 11 is mounted in the attachment groove 14 of the engine part 10, the annular projections 15*a* are elastically deformed until they assume an elastically distorted operating position indicated by the solid lines shown in FIG. 4. In the operating position, the annular projections 15*a* elastically engaged with the corresponding surfaces 14*a*–14*c* of the attachment groove 14 form hermetic seals therebetween. By the seals thus formed, the fluid passing through the valve port 13 during opening and closing operations of the reed piece 17 is prevented from leaking outside the engine part 10.

Furthermore, by virtue of the arch-shaped portion 18*a* forming the second vibration suppressing means, the reed stop 18 controls oscillation of the reed piece 17 during opening and closing operations such that the maximum amplitude of oscillation occurs at a position corresponding to a central portion of the valve port 13. With this arrangement, the distance from a source of maximum vibration to the attachment groove 14 is made longer than that of the conventional reed valve 1 shown in FIG. 5. Thus, the second vibration suppressing means formed by the arch-shaped portion 18*a* of the reed stop 18 operates to suppress transmission of vibration from the reed piece 17 to the attachment groove 14 of the engine part 10. This may add to the sound-reducing effect of the reed valve 11.

It has experimentally proved that the reed valve 11 of the present invention used in place of the conventional reed valve 1 is able to achieve about a 30%-reduction in the level of acceleration when measured at an upper cover of an engine while the engine is running at speeds varying in the range of 2000 to 3000 r.p.m.

As thus far explained, the reed valve of the present invention can readily and surely suppress transmission of vibration from the reed piece to the engine part during repetitive opening and closing operations of the reed piece. This ensures that the engine does not produce an abnormal sound or noise resulting from operation of the reed valve.

Although only one embodiment of the present invention has been disclosed and described, it is apparent that other embodiments and modifications of the invention are possible. For instance, the reed valve of the present invention may be incorporated in an engine for supplying air into the intake system.

The present disclosure relates to the subject matter of Japanese Patent Application No. 2001-047061, filed Feb. 22, 2001, the disclosure of which is expressly incorporated herein by reference in its entirety.

What is claimed is:

1. A reed valve for an engine having an engine part defining a passage for a fluid and having an annular groove opening to the passage, comprising:

a valve plate having a valve port formed at a central portion thereof for the passage therethrough of the fluid and further having an outer peripheral portion adapted to be disposed in the annular groove of the engine part in an embraced fashion so as to attach the reed valve to the engine part;

a resilient sheet-like reed piece capable of opening and closing the valve port in response to the pressure of the fluid passing through the valve port;

a reed stop defining an open position of the reed piece, the reed piece and the reed stop together being fixed in a cantilevered fashion to one surface of the valve plate by a clamp member in such a manner that the reed piece normally closes the valve port; and vibration suppressing means for suppressing transmission of vibration, caused due to opening and closing operations of the reed piece, to the fixed mounting portion, the vibration suppressing means comprising an elastic annular projection disposed on one of an outer peripheral surface of the valve plate, a pair of upper and lower surfaces of the outer peripheral portion of the valve plate, and both of the outer peripheral surface and the upper and lower surfaces of the outer peripheral portion of the valve plate, wherein when the outer peripheral portion of the valve plate is disposed in the annular groove of the engine part, the elastic annular projection is elastically engaged with, and partly deformed elastically by, a surface of the annular groove to thereby elastically support the reed valve in a floating condition within the annular groove of the engine part, the partly deformed elastic annular projection being further elastically deformable to absorb vibrations caused during opening and closing operations of the reed piece.

2. The reed valve according to claim 1, further including a gasket of a thin film of elastic material disposed on the outer peripheral portion of the valve plate, wherein the elastic annular projection is formed integrally with the gasket.

3. The reed valve according to claim 1, wherein the reed stop has an arch-shaped portion projecting outward away from the valve plate and extending diametrically across over the valve port, and the vibration suppressing means further comprises the arch-shaped portion of the reed stop.

4. The reed valve according to claim 3, wherein the arch-shaped portion of the reed stop has an apex corresponding in position to a central portion of the valve port.

5. The reed valve according to claim 3, wherein the reed stop has a vent hole formed in the arch-shaped portion in a concentric relation to the valve port, the vent hole being smaller in size than the valve port.

6. The reed valve according to claim 4, wherein the reed stop has a vent hole formed in the arch-shaped portion in a concentric relation to the valve port, the vent hole being smaller in size than the valve port.

7. The reed valve according to claim 2, wherein the reed stop has an arch-shaped portion projecting outward away from the valve plate and extending diametrically across over the valve port, and the vibration suppressing means further comprises the arch-shaped portion of the reed stop.

8. The reed valve according to claim 7, wherein the arch-shaped portion of the reed stop has an apex corresponding in position to a central portion of the valve port.

9. The reed valve according to claim 7, wherein the reed stop has a vent hole formed in the arch-shaped portion in a concentric relation to the valve port, the vent hole being smaller in size than the valve port.

10. The reed valve according to claim 8, wherein the reed stop has a vent hole formed in the arch-shaped portion in a concentric relation to the valve port, the vent hole being smaller in size than the valve port.

* * * * *